United States Patent [19]

Steiner

[11] 4,111,544

[45] Sep. 5, 1978

[54] APPARATUS AND METHOD FOR NOISE IMMUNITY FOR CONTROL SIGNALS IN ELECTROSTATOGRAPHIC PROCESSING MACHINES

[75] Inventor: Edward L. Steiner, Macedon, N.Y.

[73] Assignee: Xerox Corporation, Stamford, Conn.

[21] Appl. No.: 677,110

[22] Filed: Apr. 15, 1976

[51] Int. Cl.[2] ..... G03G 21/00

[52] U.S. Cl. ..... 355/14; 174/35 R; 250/515

[58] Field of Search ..... 355/14; 174/35 R, 35 C, 174/35 MS; 250/238, 239, 515

[56] References Cited

U.S. PATENT DOCUMENTS

| | | | |
|---|---|---|---|
| 3,385,970 | 5/1968 | Coffin et al. | 250/239 X |
| 3,398,289 | 8/1968 | Brewster | 250/238 |
| 3,493,760 | 2/1970 | Hoadley | 174/35 MS |
| 3,944,360 | 3/1976 | Deetz et al. | 355/14 |
| 3,982,058 | 9/1976 | Hill | 174/35 MS |

OTHER PUBLICATIONS

*The Optoelectronics Data Book for Design Engineers;* Texas Instruments, Inc., 2nd Ed., pp. 145–149, 1975.

*Primary Examiner*—A. D. Pellinen

[57] ABSTRACT

To minimize the effects of electromagnetic noise on signals generated by a data processing unit controlling the process stations in an electrostatographic machine, the data processing unit itself is encased in a shielded housing to thwart electromagnetic radiation. Output signals from the data processing unit are distributed to remote interface units located throughout the electrostatographic machine where the signals are stored and used to control networks actuating the electrostatographic process stations. Electro-optic couplers are used in transmitting input and output signals to and from the data processing unit to further minimize noise isolation.

3 Claims, 6 Drawing Figures

APPARATUS AND METHOD FOR NOISE IMMUNITY FOR CONTROL SIGNALS IN ELECTROSTATOGRAPHIC PROCESSING MACHINES

Application Ser. No. 677,108 and Ser. No. 677,109, filed on Apr. 15, 1976 by the same inventor and assigned to the same assignee, are related hereto.

This invention relates generally to electrostatographic reproduction machines and more particularly to apparatus for improving the integrity of control signals developed in a data processing unit and transmitted to the processing stations of the electrostatographic machine.

As electrostatographic reproduction machines have become larger and more complex, it has become advantageous to the control the processing stations with a data processing unit. The use of a central processing unit has provided numerous advantages in adaptability and flexibility in the electrostatographic machine operation. Typically, the data processing unit, in response to appropriate clocking and sensor input signals, can generate control signals. The logic signals from the data processing unit actuate control circuits for the processing station apparatus. The data processing unit transmits the control signals to a location which is typically remote. Moreover, it is possible during the transmission of the logic signals that noise can jeopardize the integrity of the transmission of the control signals. Moreover, the electrostatographic reproduction machine can be a rich source of noise. For example, the corotron devices produce a varied noise spectrum as will the flash lamp current pulse.

It is known in the prior art to provide shielding for cables transmitting the logic control signals. This shielding can be both expensive and only partially successful for most practical shielding structures.

It is further known that logic signals can be encoded with additional information in the form of an error-correcting code such that the original logic signal can be reconstructed after transmission. However, such encoding techniques typically involve extensive electrical apparatus to implement and can provide an unacceptable complication.

In the presence of a potentially noisy environment, sampling techniques and multiple processing of the same information with decision logic to determine statistically the most probably correct logic state resulting from a signal manipulation operation may be used. The duplication of processing operations as well as the statistical decision information apparatus can provide unacceptable complications.

It is therefore an object of the present invention to provide an improved electrostatographic reproduction apparatus.

It is another object of the present invention to provide apparatus for enhancing the integrity of control signal distributed through the electrostatographic process device.

It is a more particular object of the present invention to provide for periodic transmission of control signals to all remote processing stations in electrostatograpnic reproduction machines.

It is another more particular object of the present invention to provide a remote interface unit associated with remote processing stations in an electrostatographic reproduction machine which accepts and stores transmitted control signals, the control signals being utilized to control the operation of the remote processing station apparatus.

It is still another more particular object of the present invention to provide apparatus associated with the remote processing locations of an electrostatographic reproduction machine to inactivate the processing in the absence of the control signals transmitted in a predetermined time interval.

It is still another more particular object of the present invention to provide, in association with the image processing apparatus in an electrostatographic reproduction machine in which precise timing activation is required, apparatus for recognizing a predetermined sequence of transmitted control signals to the remote station.

It is yet another more particular object of the present invention to provide apparatus, in electrostatographic reproduction machines for providing apparatus for checking correct transmission of information to remote processing locations.

The aforementioned and other objects are accomplished according to the present invention by providing groups of instruction signals to be transmitted periodically to the remote interface units for controlling the performance of the electrostatographic processing operations. The instruction signals can be periodically updated in a data processing unit on the baisis of input signal information, or on the basis of a predetermined time sequence of the instruction signals. The control signals, transmitted from the data processing unit, are received in the remote interface unit and stored therein. Logic apparatus examines the contents of the stored information and provides, in response to predetermine the combination of instruction logic signals, appropriate signals for control of the image processing apparatus associated with the remote processing station.

In the event that activation of a remote image processing device is to be performed at a predetermined time, the control signal activating the processing apparatus is transmitted following a transmission of the preselected sensitizing signal. When the sensitizing and control signals are transmitted in a pre-established time relationship, an appropriate image processing device signal is thereafter generated.

Apparatus is included at the remote station interface unit for automatically inactivating the remote station processing apparatus in the event that a control signal is not transmitted within a predetermined time. In addition, a return path is provided for the transmitted signals as a check against systematic errors.

In addition to shielding around the data processing unit, other devices are incorporated to aid in rejection of noise signals. The data processing unit is accessible only through electro-optic couplers. Input signals are sampled to enhance the logic state identification reliability.

These and other features of the invention will be understood upon reading the following description in conjunction with the figures which include:

Figure 1:
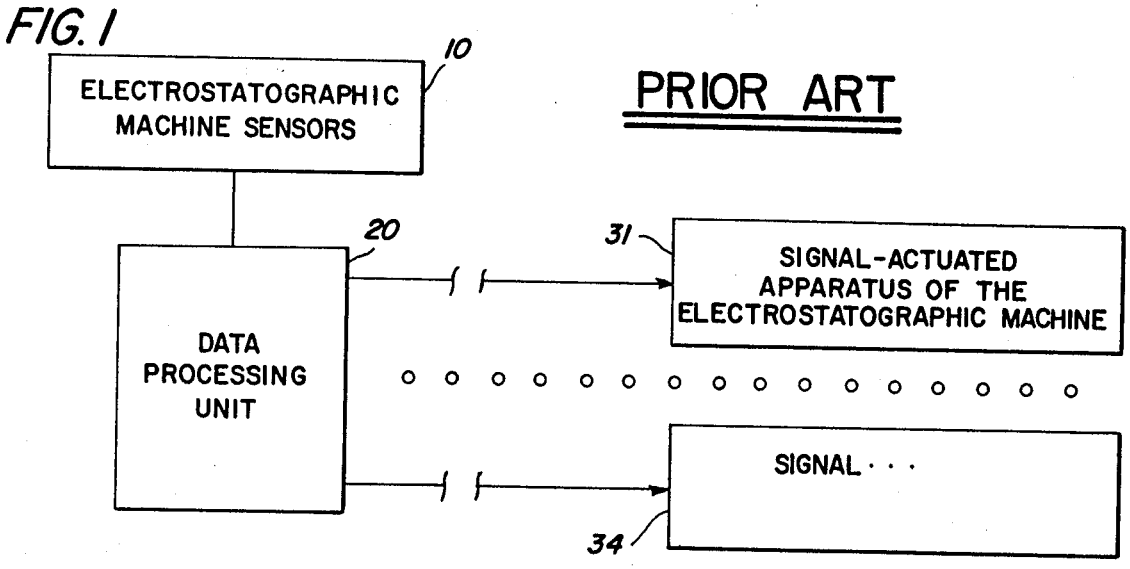
FIG. 1 is a schematic diagram of the apparatus controlling the processing stations of an electrostatographic machine according to the prior art.

Referring now to FIG. 1, a schematic diagram of a system for controlling the processing stations of an electrostatographic reproduction machine by means of a data processing unit, according to the prior art is shown. A data processing unit 20 receives input signals from the electrostatographic machine sensors 10. The input signals can be status signals, signals identifying a position of a copy sheet, clocking signals derived from the machine components, fault condition signals or any other signal which can be utilized to control the machine processing stations. On the basis of the input signals, the data processing unit 20 produces appropriate control signals which are applied to signal actuated apparatus 31 through 34 of the electrostatographic machine processing stations. The signal actuated apparatus 31 through 34 can include solenoids, flash lamps, etc., and the electronic circuits actuating these components. The processing stations can include sorters, paper handling devices and devices for which the operation should be determined by the actual image processing of the electrostatographic machine.

As discussed above, certain components of electrostatographic reproduction machine such as the corotrons and the flash lamps, provide a rich source of electromagnetic noise. This noise can enter the system shown in FIG. 1 by several paths. The machine sensors 10 can provide erroneous output signals in the presence of noise and the integrity of the sensor output signals as applied to data processing unit 20 can be jeopardized by noise entering the electrical connections coupling the sensors and the data processing unit. Similarly, the integrity of the control signals applied from the data processing unit 20 to the signal actuated apparatus 31 through 34 can be impaired. But more importantly, the integrity of the data processing unit can be jeopardized by electromagnetic noise. For example, the logical manipulation by the data processing unit of the input signals necessary for determination of the processing station operation can be vulnerable to noise. And as the data processing unit becomes increasingly dependent on stored programs capable of being electrically altered for greater operational flexibility, the accuracy of the stored control program can be impaired.

Figure 2:
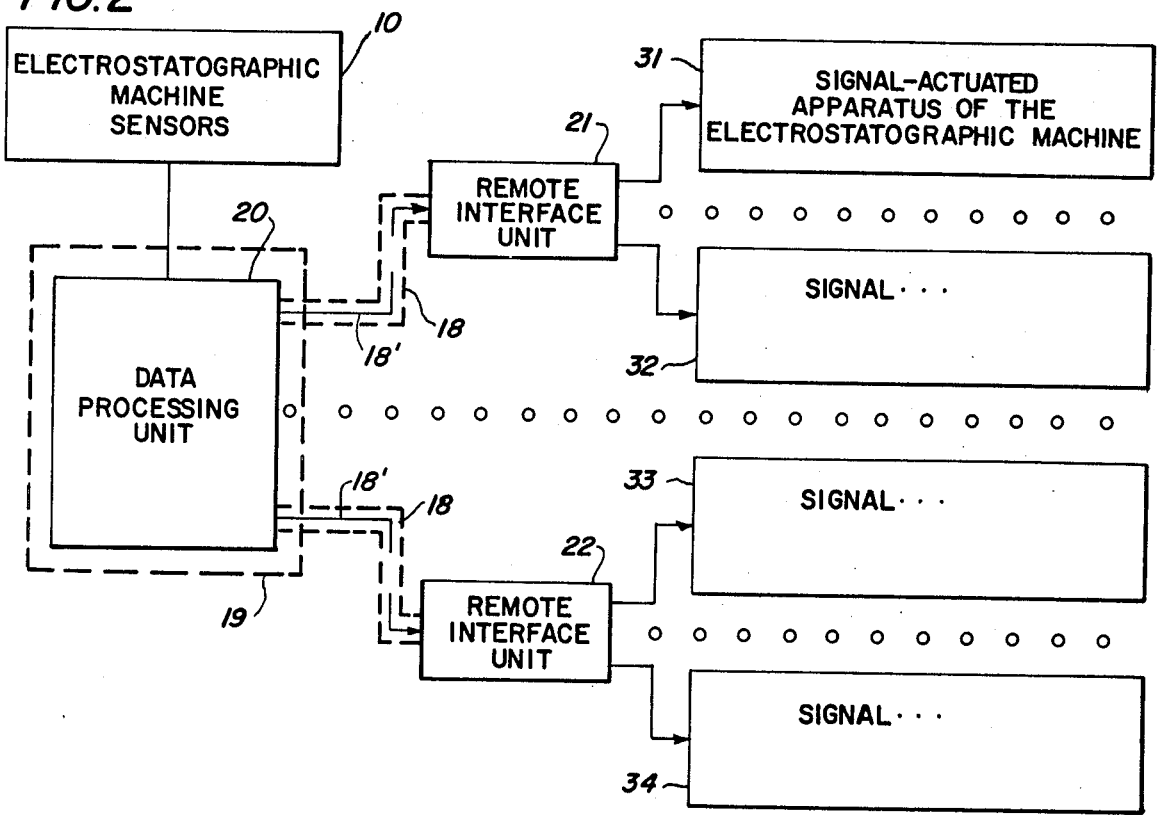
FIG. 2 is a schematic diagram of the apparatus controlling the processing stations of an electrostatographic machine according to the present invention.

Referring next to FIG. 2, a schematic diagram of a system for controlling the processing stations of an electrostatographic reproduction machine by means of a data processing unit, according to the present invention is shown. The data processing unit 20 receives input signals from the electrostatographic machine sensors 10. However, instead of delivery control signals directly to the signal actuated apparatus, instruction signals are delivered to remote interface units 21 through 22. The instruction signals are decoded by the apparatus of the remote interface unit, thereby obtaining control signals which are applied to the signal actuated apparatus of the electromagnetic machine.

In this system, the data processing unit 20 can be shielded from the electromagnetic noise generated by components of the reproduction machine. This shielding can take the form of an appropriate material (indicated by covering 19 in FIG. 2). The coupling of logic signals into and out of data processing unit 20 can be accomplished by electro-optic elements, thereby eliminating direct electrical coupling to the data processing unit. Shielding can also be accomplished by removing the data processing unit to a distance from the reproduction components for which the resulting electromagnetic noise is sufficiently diminished for accurate operation of the data processing unit. In this manner, the operation of the data processing system can be rendered more reliable.

In an effort to increase the accuracy of the input signals, the data processing unit can sample the input signals and by appropriate logic apparatus, can statistically determine the most probably logical state of an input signal.

The remote interface unit can be equipped with apparatus to store the instruction signals. Accurate transfer of the instruction signals between the data processing unit 20 and the remote interface units can be enhanced by several methods. The electrical couplings 18' between the data processing unit and the remote interface units 21 through 22 can be shielded as by shield material 18. The accuracy of instruction signal transfer can be enhanced by having the instruction signals encoded by the data processing unit in a format which can tolerate the presence of noise, i.e., in an error-correcting code, and by having appropriate decoding apparatus in the remote interface units. Accuracy of instruction signal transfer can be enhanced by the addition of electrical couplings from the remote interface unit to the data processing unit and the addition of apparatus for periodically integrating the instruction signals stored in the remote interface unit. A still further method of enhancing the accuracy of the instruction signals stored in the remote interface unit is to refresh these instruction signals periodically, thereby correcting any errors which can occur due to noise. Finally, the remote interface units themselves can be shielded, if necessary to increase the reliability of signals entered into the remote interface units.

Because the remote interface units are located in the preferred embodiment relatively close to the related signal actuate apparatus, the shortened electrical couplings provide relative immunity to noise induced by electromagnetic radiation as compared to the longer electrical couplings.

Figure 3:
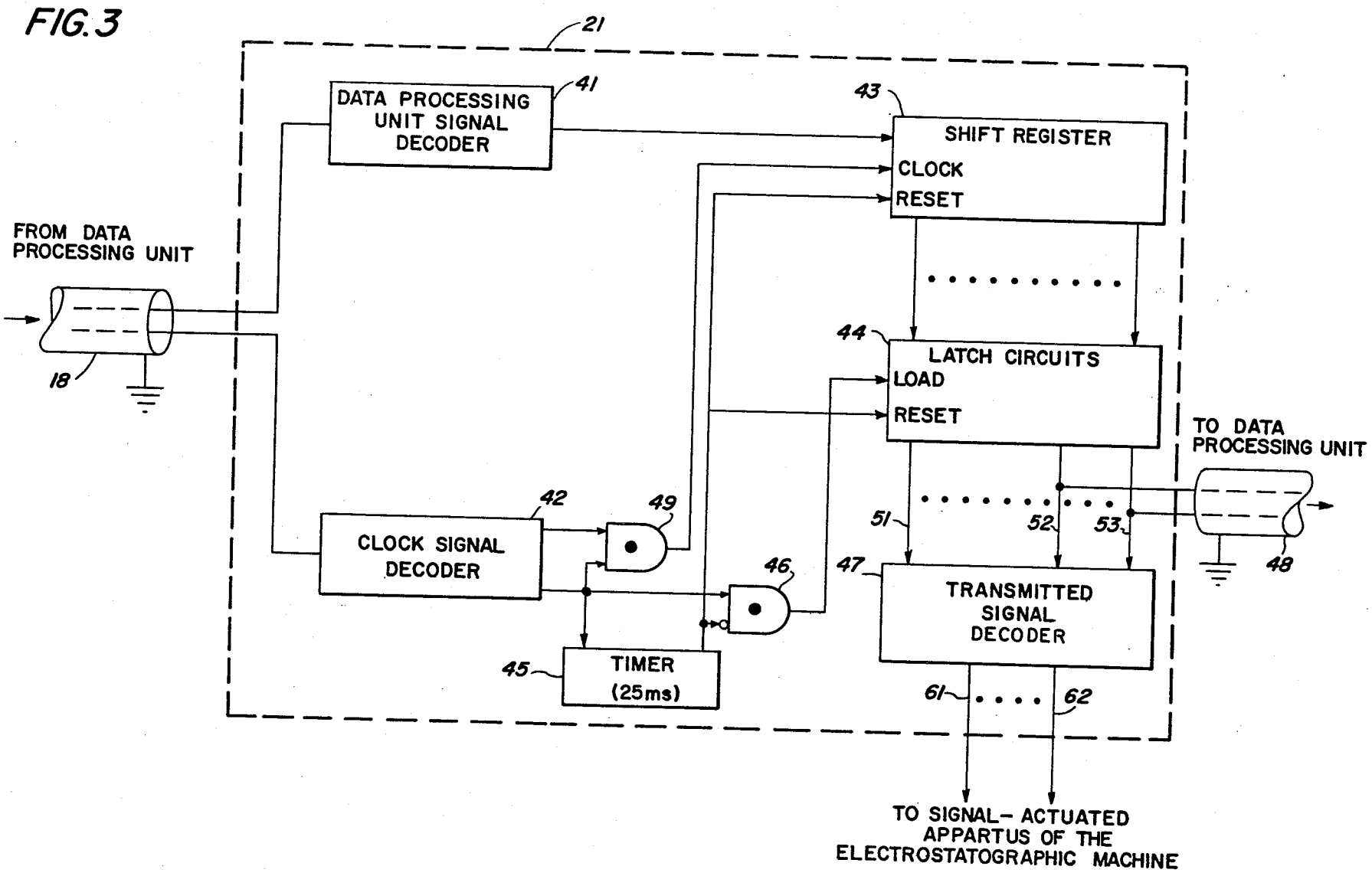
FIG. 3 is a schematic diagram of the remote interface unit utilized in controlling processing stations of an electrostatographic machine.

Referring next to FIG. 3, a schematic diagram of the apparatus comprising the remote interface unit according to the preferred embodiment is shown. The data processing unit 20 applies two sets of signals to a remote interface unit 21, a clocking signal and the instruction signal. The instruction signals contain logical signals which have encoded information containing the control of the signal actuated reproduction machine. Each clocking signal is sent with a slight delay after the transmission of an instruction signal. The clocking signal sequence has a precursor signal applied to clock signal decoder 42. The precursor signal applies an enabling logic signal to a first input terminal of logic AND gate 49, an enabling logic signal to a first input terminal of logic AND gate 46 and a logic signal to timer 45.

Timer 45 is a safety device and a negative logic signal is normally applied by the output terminal of timer 45.

A signal inverting stage associated with a second terminal of logic AND gate 46 enables gate 46. However, should a clocking pulse not be applied to the input terminal of timer 45, a positive pulse will be applied by the output terminal of timer 45, disabling gate 46 and resetting shift register 43. Timer 46 must be reactivated before data can be entered in the latch circuits.

After the precursor pulse, positive logic (clocking) signals are transmitted. Immediately before each of the clocking signals an instruction signal is applied to the data processing unit signal decoder 41. The data decoding unit, after determining whether the applied signal indicates a positive or negative logic signal, applies the appropiate logic signal to an input terminal of shift register 43. The delayed clocking signal is applied through clock signal decoder 42, through enabled gate 49 to the clock terminal of shift register 43. Thus the logic instruction signals are entered and shifted in the shift register. In the preferred embodiment, the instruction signal contains information relating to a group of 40 logic signals and shift register 43 has 40 elements therefor. During the loading of the logic signals in shift register 43, gate 46 applies a logic signal to latch circuits 44. Latch circuits 44 then receive the signals from the shift register 43 and after the transmission of the group of instruction signals, the positive logic signal is removed from the first input terminal of gate 46, thereby storing the logic signals of register 43 in the latch circuits 44.

The logic signals stored in latch circuits 44 are fed via electrical couplings 51 through 53 to transmitted signal decoder 47. The signal decoder identifies predetermined patterns of logic signals in the latch circuits and in response provides appropriate signals to electrical couplings 61 through 62. The signals applied to couplings 61 through 62 control the associated signal actuated apparatus.

To provide partial verification of the integrity of the transmitted logic signals, the logic signals from two data positions, indicated in FIG. 3 by latch circuit electrical couplings 52 and 53, are returned to the data processing unit via electrical coupling 48. These two data positions are dedicated in the preferred embodiment to this checking function. One position 52 is arbitrarily, selected to provide a negative logic signal while the other checking location 53 is chosen because the logic signal associated therewith was shifted the length of shift register 43.

As described, the transmitted signal decoder 47 controls one or more of the copy processing components of the electrostatographic machine. These components comprise mechanical devices, the inertia of which prohibits response to occasional errors in the signal. Thus, even in the presence of noise, sufficient to generate errors in the control signals, these errors will have minimal effect on operation. The use of synchronized clocking signals with instruction signal transmission also enhances noise immunity.

It will be further understood that for the devices, such as a flash lamp in which relatively precise activation is required, the present apparatus envisions a two stage process. A series of sensitizing signals is first transmitted to the apparatus. The sensitizing signals prepare the apparatus to be triggered by a succeeding trigger signal. In fact a plurality of trigger signals are utilized. In the presence of noise, the operation is as follows. The series of sensitizing signals will prepare the apparatus for response to the trigger signals. Only one of the series of sensitizing signals has to be error free to sensitize the apparatus. Error free trigger signals will provide an accurate device activation. In the presence of noise, the device activation can be early or late. However, because the number and repetition rate of the sensitizing signals and trigger signals, the resulting copy will be acceptable. For example, in the case of the flash lamp excitation, the registration of the copy on the copy sheet will have a displacement, which except in critical circumstances will not be noticeable.

Figure 4:
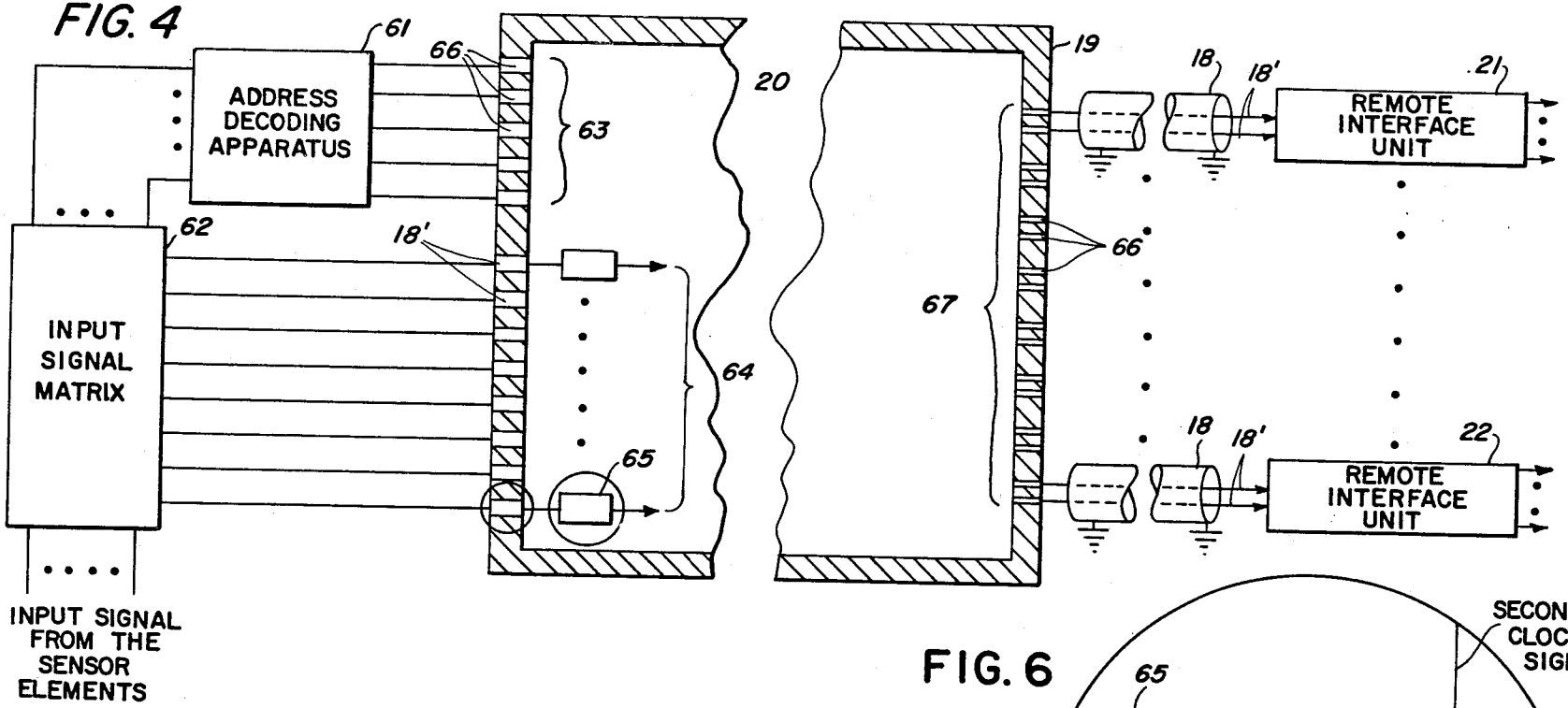
FIG. 4 is schamatic diagram of apparatus associated with the data processing unit to enhance the immunity against noise.
Figure 5:
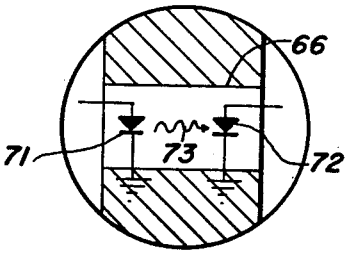
FIG. 5 is an enlarged schematic diagram showing details of the electro-optic couplers employed to transmit signals between the data processing unit and the machine.

Referring now to FIGS. 4 and 5 a schematic diagram of data processing unit 20 is there shown. In the preferred embodiment, an appropriate shielding material 19 completely encloses the data processing unit. To enter or extract signals from the shielded data processing unit, three groups of 63, 64, 67 of electro-optic elements are utilized. Each electro-optic element 66 is comprised of a light emitting diode 71 and a light sensitive element 72. A positive logic can be defined as a signal of sufficient amplitude to cause diode 71 to generate light 73 of sufficient intensity to activate the light-sensitive element 72. A negative logic signal can be defined as signal of insufficient amplitude to produce a light above the threshold level in the light sensitive element 72. Thus, logic signals can be optically transferred between elements 71, 72 eliminating direct electrical coupling and the attendant possibility for the introduction of noise.

Input signals from the sensor elements are applied to predetermined matrix locations in input signal matrix 62. It will be clear to those skilled in the art that analog signals can be reduced to a digital format, for example, by analog-to-digital converters. In the preferred embodiment, a thirty-two-column and eight-row matrix is utilized. The data processing unit 20 applies preselected logic signals to a group 63 of five electro-optic elements 66. The five logic signals transferred through the shielding 19 are applied to address decoding apparatus 61. Output signals of apparatus 61 activate one of the 32 matrix column, the particular activated column determined by the transferred logic signals.

Figure 6:
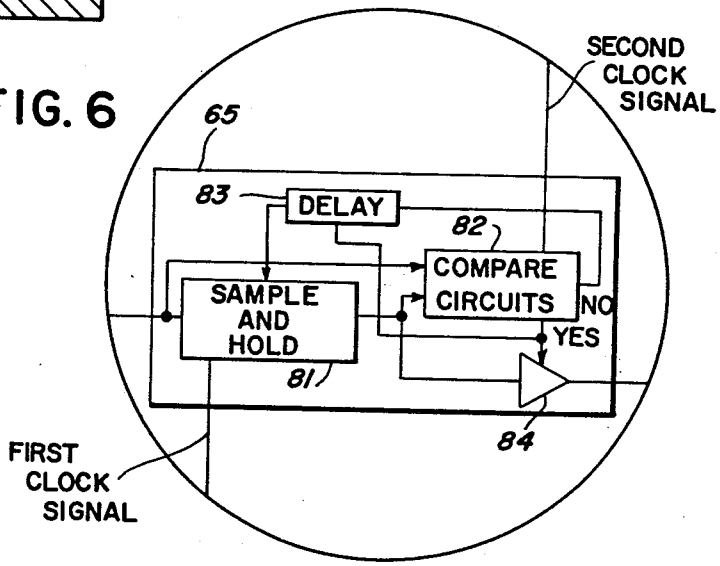
FIG. 6 is an enlarged schematic diagram of the sample and compare logic for determining noise.

The eight input signals associated with the rows of the addressed columm are applied to the group 66 of eight electro-optic elements 66. In the preferred embodiment, sample and compare elements 65 determine, in the presence of noise, the nature of the logic signal, i.e., whether the logic signal is positive or negative. Referring particularly to FIG. 6, the input signal is sampled during a first clock signal by sample and hold circuit 81. A second clock signal activates compare circuit 82 to compare the output of circuit 81 with the input signal. When the two samples measure the same logic rate, amplifier gate 84 is activated, applying to an output terminal the logic state of circuit 81. When, however, the two samples differ, a signal is applied to delay circuit 83. An output signal from the delay circuit 83 cause the sample and hold circuit 81 to determine the logic state of an input signal during another sample period. The delay circuit also actuates amplifier gate 84 causing the stored change state to be applied to the output terminal. The sampling technique can be implemented by comparing the output signal of a sample and hold circuit (first sample) with the second sample via logic circuits. In case of logic signal identity, the identified logic state is the signal utilized. When the output signal of the sample and hold circuit is different from the second sample, the logic circuit selects the state identified by the third sample. The data processing unit responsible for the particular input signals entered into the data processing unit, can then proceed with appropriate manipulation.

It is clear that several algorithms can be utilized to increase confidence in the identification of the logic signal. For example, a time averaging system can be utilized.

The aforedescribed manipulation eventually results in eight 40-bit instruction signal groups stored in a scratch pad memory of the data processing unit 20. Each 40-bit instruction signal group is associated with a remote interface unit and can be decoded by the remote interface unit to provide control signals for controlling apparatus of the electrostatic machine associated with each remote interface unit. The group 67 of eight instruction signals are periodically applied to the associated eight remote interface units along with clocking signals. The instruction signal groups 67 and the clocking signals are extracted from the shielding data processing unit via electro-optic elements. The instruction signal groups 67 along with clocking signals are delivered to the remote interface units approximately every millisecond, or when an instruction signal change results in a control signal which must be executed immediately. The instruction signal groups are updated in the scratch pad memory by the data processing unit in response to input and timing signals.

The above description is intended to illustrate the operation of the preferred embodiments and is not meant to limit the scope of the invention. Scope of the invention is to be limited only by the following claims. Many variations will be apparent to one skilled in the art that would yet be encompassed by the spirit and scope of the invention.

What is claimed is:

1. In an electrostatographic reproduction machine, a system for controlling processing stations comprising:

a data processing unit at least one remote interface unit, said interface unit being adapted to receive and store instruction signals, plural machine sensors for generating input signals, plural electrical couplings coupling said data processing unit with said remote interface unit and with said machine sensors, said data processing unit periodically transmitting said instruction signals through said electrical couplings to said remote interface unit, said remote interface unit providing control signals to associated ones of said processor stations in response to said instruction signals, and means to minimize the effects of electro-magnetic radiation on signals transmitted to and from said data processing unit including shielding means for shielding said data processing unit against electro-magnetic radiation, said shielding means including shielding material means covering said data processing unit, electro-optic coupling means between said electrical couplings and said data processing unit for transmitting input signals and instruction signals through said shielding material to and from said data processing unit, and means for determining a probable logic state of said input signals transmitted to said data processing unit through said electro-optic coupling means.

2. The control system of claim 1, wherein said data processing unit selects groups of said input signals to be received by said data processing unit.

3. The method of transmitting signals between the data processing control unit of an electrostatographic reproduction machine and the operating stations of said machine while minimizing the effect of electro-magnetic radiation on said data processing control unit, comprising the steps of:

enclosing said data processing control unit in a shielding material;

distributing signals from said data processing control unit to said machine operating stations through at least one interface unit separated from said data processing control unit to reduce electro-magnetic radiation;

entering and extracting signals into and out of said data processing control unit through noise inhibiting couplers; and sampling signals entering said data processing unit and comparing said sampled signals with others of said signals entering said data processing unit to determine the accuracy of said signals.

* * * * *